United States Patent [19]

Schedele

[11] 4,360,794

[45] Nov. 23, 1982

[54] ELECTROMAGNETIC FLAT RELAY

[75] Inventor: Helmut Schedele, Diessen, Fed. Rep. of Germany

[73] Assignee: Siemens Aktiengesellschaft, Berlin and Munich, Fed. Rep. of Germany

[21] Appl. No.: 262,128

[22] Filed: May 11, 1981

[30] Foreign Application Priority Data

Jun. 23, 1980 [DE] Fed. Rep. of Germany ... 8016573[U]

[51] Int. Cl.[3] ..... H01H 45/04

[52] U.S. Cl. ..... 335/202; 335/187

[58] Field of Search ..... 335/202, 187, 132

[56] References Cited

U.S. PATENT DOCUMENTS 3,544,930 12/1970 Hans Sauer ..... 335/154

4,087,667 5/1978 Heider et al. ..... 200/245

*Primary Examiner*—Harold Broome

*Attorney, Agent, or Firm*—Hill, Van Santen, Steadman, Chiara & Simpson

[57] ABSTRACT

An electromagnetic flat relay has an elongated carrier element which is disposed inside of the hollow coil spool and parallel to the longitudinal axis thereof. The carrier element consists of non-ferromagnetic material and supports the yoke and the pole piece and is directly or indirectly connected to one or more contact elements. The base of the carrier element rests on the yoke and the pole piece opposite the armature and has laterally depending flanks which at least partially surround the yoke and the pole piece.

4 Claims, 7 Drawing Figures

ELECTROMAGNETIC FLAT RELAY

BACKGROUND OF THE INVENTION

1. Field of the Invention

The present invention relates to electromagnetic relays, and in particular to electromagnetic flat relays having the operative components of the relay disposed in the hollow interior of the coil spool.

2. Description of the Prior Art

Electromagnetic flat relays are known, for example, from German Auslegeschrift 16 39 417 and German Offenlegungsschrift 25 02 078. Such flat relays have a hollow central portion in the interior of the coil spool in which is disposed a contact carrier consisting of insulating material which, in addition to the contact elements, also carries the operative magnetic components and is axially inserted into the coil spool. A plastic carrier of this type because of space limitations does not have a large cross-section and thus presents the problem that the operative magnetic components and the contact elements which are secured to the carrier exhibit relatively unstable tolerance values between the components. Even if the contacts are accurately adjusted as to position before insertion of the carrier in the coil spool, twisting and other distortions of the carrier may still occur following insertion as a result of the poor mechanical stability of the plastic carrier so that the adjusted values change by an unknown amount.

SUMMARY OF THE INVENTION

It is an object of the present invention to provide a flat relay having the operative magnetic components carried and supported on a carrier element in the hollow interior of the coil spool in which the contact elements are firmly secured in their respective positions so that the relative positions of the contact elements is not changed by insertion of the carrier and components attached thereto into the coil former.

The above object is inventively achieved in a flat relay in which the carrier consists of a non-ferromagnetic metal and has a U-shaped profile or cross-section and has a base which rests on the yoke and the pole piece opposite the armature. The carrier further has lateral flanks which at least partially enclose the yoke and the pole piece.

A carrier for a flat relay constructed as described above, in the form of a metal bar having a U-shaped cross-section, exhibits considerably improved stability compared to conventional plastic carriers. A metal bar of this type requires only a small thickness to achieve sufficient mechanical stability, so that the overall height of the relay can be reduced. Moreover, the mechanical stability of the metallic carrier insures a high resistance to bending and distortion so that a plurality of contact carriers can be arranged adjacent to one another with the relative dimensions between contacts remaining stable so that the contact elements and associated contacts can be actuated by a common armature.

The mechanical stability of the carrier is insured by relatively short laterally depending flanks of the carrier forming the U-profile. The lateral flanks may partially or entirely surround the yoke and the pole piece on which the carrier rests. The contact elements which are held in an insulating body and face the carrier are secured on the yoke and on the pole piece and are thus indirectly connected to the carrier. A further embodiment employing the inventive concept disclosed herein exhibits lateral flanks of the carrier which also surround the contact elements and carry the elements directly by means of laterally engaging supporting elements. The armature disposed between the carrier and the contact elements is flat and is designed in a known manner and fixed on the yoke, for example, by means of a biasing spring. The insulating material body which carries the contact elements may have a stop for limiting the movement of the free end of the armature.

In order to enclose the magnetic circuit a further embodiment of the invention employs a yoke and/or a pole piece which are angled outside of the coil spool so that the angled portions thereof abut against a ferromagnetic housing cap. The angled portions of those elements preferably are directed upward or downward depending upon the type of arrangement of contact spring terminals which is employed.

DESCRIPTION OF THE PREFERRED EMBODIMENTS

Figure 1:
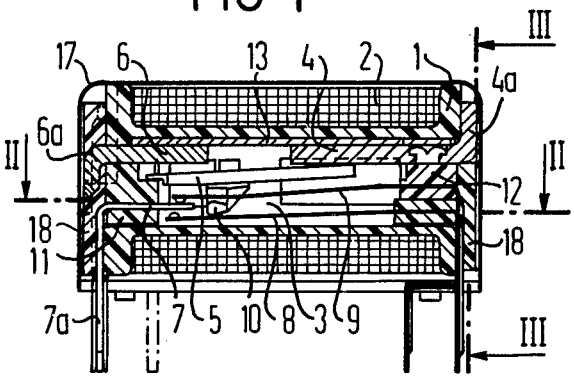
FIG. 1 is a sectional view of a flat relay constructed in accordance with the principles of the present invention.
Figure 2:
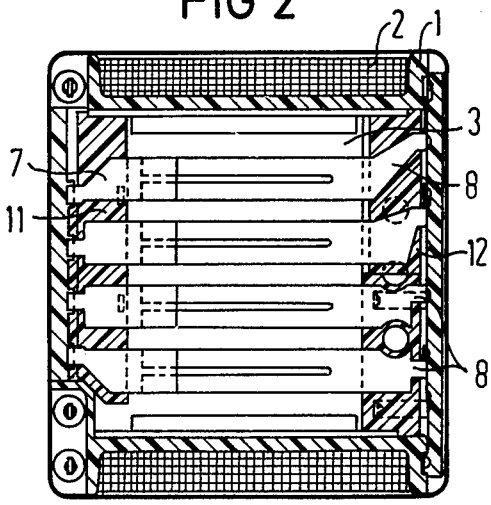
FIG. 2 is a sectional view taken along line II—II of FIG. 1.
Figure 3:
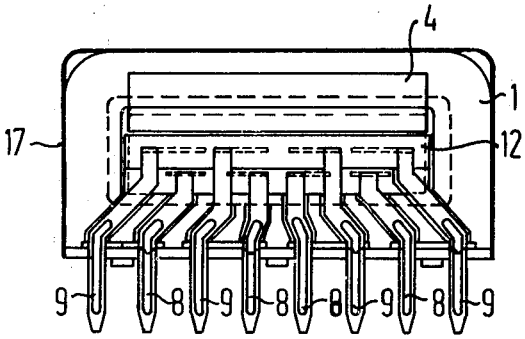
FIG. 3 is a sectional view taken along line III—III of FIG. 1.

A flat relay constructed in accordance with the principles of the present invention is shown in various sectional views in FIGS. 1, 2 and 3. The relay has a coil spool 1 on which the coil or winding 2 is wound and which has a hollow interior 3. Within the interior 3 is disposed the magnetic system for the relay comprising a yoke 4, an overlying flat armature 5 and a pole piece 6. The interior 3 further contains one or more contact elements, and in the embodiment shown in FIGS. 1, 2 and 3 contains four switching contacts mounted on a stationary center contact element 7 and two opposing movable contact elements 8 and 9, in the form of leaf springs, which are operated by means of an actuation element 10 which is attached to or integrally formed on the armature 5. The center contact element 7 is held in an insulating material body 11 by embedding or other means, whereas the movable contact elements 8 and 9 are fixed in a one-part or multi-part insulating material body 12. The insulating material body 11 is secured to the pole piece 6 by means of screws, rivets, or other suitable means known to those skilled in the art and the insulating material body 12 is similarly secured to the yoke 4.

Figure 4:
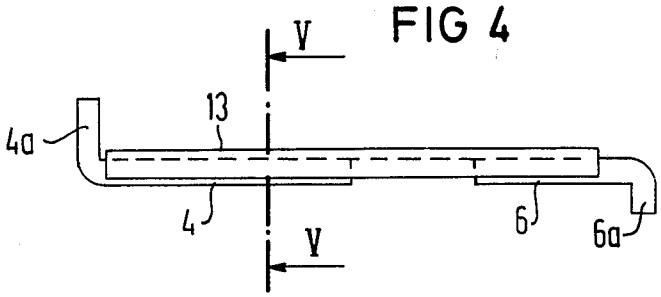
FIG. 4 is a side view of a carrier element constructed in accordance with the principles of the present invention of the type shown in FIG. 1.
Figure 5:
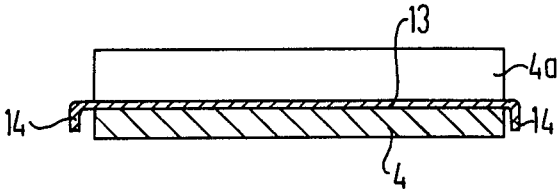
FIG. 5 is a sectional view of the carrier element taken along line V—V of FIG. 4.
Figure 6:
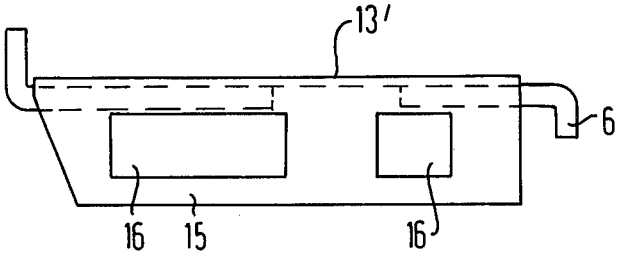
FIG. 6 is a second embodiment of the carrier element shown in FIG. 4 having longer laterally depending flanks.
Figure 7:
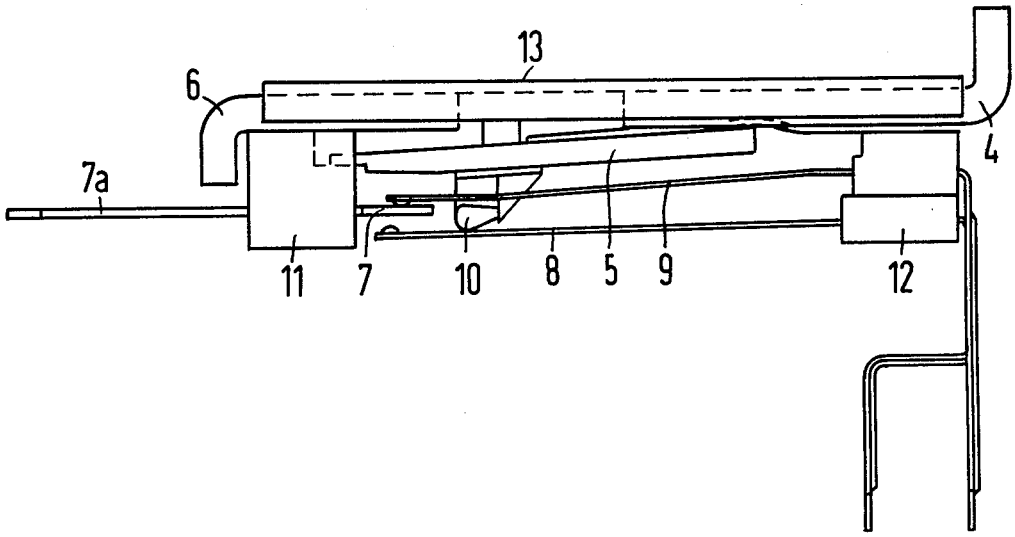
FIG. 7 is a side view of a pre-adjusted unit for insertion in the interior of the coil spool of FIG. 1 with all elements being secured on a common carrier.

All elements arranged inside the coil spool 1 are secured on a common carrier element 13 which consists of non-ferromagnetic material such as, for example, nickel silver, and exhibits a U-shaped cross-section or profile as shown in FIG. 7 before insertion. FIGS. 4 and 5 illustrate a first embodiment of the carrier 13 and FIG. 6 shows a second embodiment for the carrier element designated 13'.

The carrier 13 shown in FIGS. 4 and 5 possesses relatively short lateral flanks 14 having a length which corresponds approximately to the thickness of the yoke 4 and the pole piece 6, and may be slightly less than those thicknesses. When in place in conjunction with the pole piece 6 and the yoke 4, the flanks 14 partially or completely embrace the lateral portions of those elements.

In the embodiment shown in FIG. 6, the common carrier element 13' is provided with longer lateral flanks 15. In this embodiment, the lateral flanks 15 embrace the insulating material bodies 11 and 12 for the contact elements as well as surrounding the yoke 4 and the pole piece 6. The insulating material bodies can then be directly connected to the carrier 13' by means of engagement in correspondingly shaped recesses 16.

In order to assemble the relay all components of the magnetic system and the stationary the movable contact springs are first connected to the carrier 13, or the carrier 13', and the dimensions are appropriately adjusted between elements outside of the coil spool 1. The connection pins *7a* of the center contact element is not yet angled at this time. The assembled and adjusted switching elements together with the carrier 13 as shown in FIG. 7 can then be inserted into the wound coil spool 1. As shown in FIG. 1, insertion of the carrier 13 and the elements attached thereto is effected from the right side of the relay. After insertion of the carrier 13 and the associated magnetic system the connection pins *7a* are bent downward. The interior 3 and the entire relay can be subsequently sealed by bonded foils 18 or similar means known to those skilled in the art on both front sides. A ferromagnetic cap 17, which may be filled with a sealing compound, is put over the relay components. In order to improve the magnetic transition the outer end *4a* of the yoke 4 and the outer end *6a* of the pole piece 6 are angled at right angles to the portions of those elements in the interior of the spool 1 so as to abut against the cap 17.

Although modificatins and changes may be suggested by those skilled in the art it is the intention of the inventor to embody within the patent warranted hereon all changes and modifications as reasonably and properly come within the scope of his contribution to the art.

I claim as my invention:

1. An electromagnetic flat relay comprising a hollow spool on which a coil is wound, a flat armature, a yoke and a pole piece disposed inside said coil spool, one or more contact elements engaging said armature for comovement therewith and a carrier element having a U-shaped cross-section consisting of non-ferromagnetic metal and having a base which rests on said yoke and said pole piece opposite said armature and which has laterally depending flanks which at least partially surround said yoke and said pole piece, said yoke, said pole pice, said armature and said contact elements being connected to said carrier for insertion inside said spool as a pre-adjusted unit.

2. The electromagnetic flat relay of claim 1 further comprising at least one insulating material body for supporting said contact elements, said insulating material bodies being secured to at least one of said yoke and said pole piece opposite said carrier element.

3. The electromagnetic flat relay of claim 1 wherein said contact elements are supported in one or more insulating material bodies, and wherein said carrier element has laterally depending flanks which surround said contact elements, said flanks having recesses for receiving and retaining said insulating material bodies.

4. The electromagnetic flat relay of claim 1 wherein said yoke and said pole piece each have portions thereof extending outside of said spool, said portions being angled against said spool, and said relay further comprising a ferromagnetic housing cap which abuts said portions of said yoke and said pole piece.

* * * * *